United States Patent [19]

Karasawa et al.

[11] 4,317,845

[45] Mar. 2, 1982

[54] ONE SIDE SURFACE MOLTEN METALLIC COATING METHOD AND APPARATUS THEREOF

[75] Inventors: Kunihiko Karasawa, Yokohama; Tokushiro Hosoda, Tokyo; Hiroshi Mase; Yasuo Sato, both of Yokohama; Shoji Shimada, Kamakura, all of Japan

[73] Assignees: Asahi Glass Co. Ltd.; Nihon Parkerizing Co., both of Tokyo, Japan

[21] Appl. No.: 136,339

[22] Filed: Apr. 1, 1980

[51] Int. Cl.[3] ..... C23C 1/02

[52] U.S. Cl. ..... 427/47; 427/432; 427/433; 427/434.4; 118/623; 118/419; 118/421

[58] Field of Search ..... 427/47, 434.3, 300, 427/433; 118/623, 421, 419

[56] References Cited

FOREIGN PATENT DOCUMENTS

| | | | |
|---|---|---|---|
| 2656524 | 6/1978 | Fed. Rep. of Germany | 427/300 |
| 54-122640 | 9/1979 | Japan | 427/47 |
| 54-125136 | 9/1979 | Japan | 427/434.3 |

*Primary Examiner*—Ralph S. Kendall

*Attorney, Agent, or Firm*—Oblon, Fisher, Spivak, McClelland & Maier

[57] ABSTRACT

One side surface of a continuous metal strip is continuously brought into contacted with a surface of a molten metal bath. The surface of the molten metal bath is flowed to the directions departing from both edges of the strip by a linear induction motor dipped in the bath. A one side surface metal coated product having no deposition of a molten metal on the reverse surface is obtained by the method of the present invention.

11 Claims, 6 Drawing Figures

ONE SIDE SURFACE MOLTEN METALLIC COATING METHOD AND APPARATUS THEREOF

BACKGROUND OF THE INVENTION

1. Field of the Invention

The present invention relates to a one side surface molten metallic coating method for coating on one side only of a continuous metal.

2. Description of the Prior Art

It has been developed to use strips coated on one side only which are prepared by coating a molten metal on one side only to improve anticorrosive and soldering characteristics and which are used in the cars and household electric instruments etc.

An electric plating process has been known as the process for preparing a strip of metal coated on one side only. In the electric plating process, the productivity is low and the cost is high in order to prepare a sheet or strip of metal on which a large amount of molten metal is coated. Moreover, the process could not be applied for coating aluminum etc.

On the contrary, if a hot dipping process for coating a strip of metal by immersing it in a molten metal bath, can be applied on one side only, the advantages are remarkable from the economical and technical viewpoints. Various processors have been proposed.

U.S. Pat. No. 3,149,987 and U.S. Pat. No. 3,121,019 disclose the processes for coating on one side only by coating sodium bentonite or an alkaline earth hydroxide on a rear surface to form a coating and immersing it in a molten metal bath and then, removing the coating of sodium bentonite or an alkaline earth hydroxide. These processes include the step of coating a resist on the rear surface and the step of removing the resist after the molten metallic coating whereby the processes are remarkably complicated and the resist coated on the rear surface contaminates the molten metal bath and the contaminated molten metal is coated to cause a trouble.

U.S. Pat. No. 4,082,868 and U.S. Pat. No. 4,114,563 disclose the process for coating a molten metal on one side surface of a strip by placing a deflector roll near a bath surface to form meniscus by a surface tension of a molten metal between the strip passing the roll and the molten metal surface.

In the process, the surface tension of the molten metal is utilized, and accordingly, a gap between the molten metal surface and the strip should be precisely maintained. Thus, the edge of the strip has a strain in itself whereby a distance to the molten metal surface is varied by vibration caused by the running thereby causing disadvantages of a partial uncoated surface or a wraparound of a molten metal from an edge to the opposite surface.

SUMMARY OF THE INVENTION

It is an object of the present invention to provide a one side surface molten metallic coating method to precisely coat a molten metal on only one side surface without a wraparound on the reverse surface from the edge of the strip even though the edge of the strip is vibrated.

The foregoing and other objects of the present invention have been attained by flowing the surface of the molten metal bath to directions departing from both edges of the strip by a linear induction motor and contacting continuously one side surfaces of the continuous metal strip with the surface of the flowing molten metal bath.

DETAILED DESCRIPTION OF THE PREFERRED EMBODIMENTS

Figure 1:
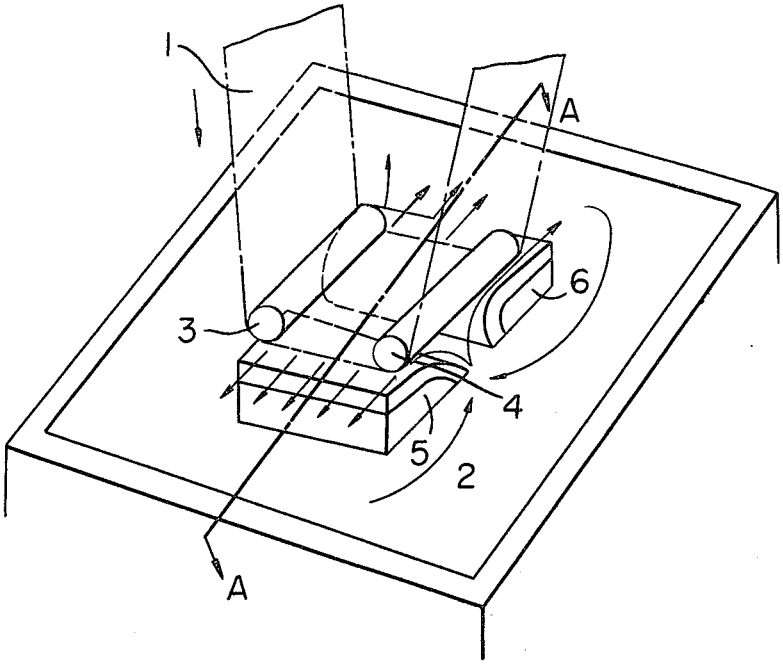
FIG. 1 is a perspective view of one embodiment of the present invention.

In accordance with the method of the present invention, the surface of the continuous metal strip is cleaned by removing oxides and oils adhered on the surface and the metal strip is continuously fed on the surface of the molten metal bath to coat the molten metal on the one side surface of the metal strip by contacting it with the surface of the molten metal bath (hereinafter referring to as a molten metal surface).

The molten metal surface with which the surface of the metal strip is brought into contact is flowed to directions departing from both edges of the strip. The flow of the molten metal surface is to prevent a wraparound of the molten metal on the reverse surface when the edge of the strip is lower than the level of the normal molten metal surface by a strain or vibration. The flow of the molten metal on the surface is not critical to the precise perpendicular direction to the running of the metal strip though certain perpendicular directional velocity component is required.

In the specification, the flow velocity on the molten metal surface means the velocity component in the perpendicular direction to the running of the metal strip.

A distance between the metal strip and the molten metal surface to initiate the wraparound of the molten metal on the reverse surface in the condition that the metal strip is lower than the level of the molten metal bath, is depending upon the flow velocity of the molten metal surface.

When the molten metal is made of zinc as a main component, a distance between the strip and the molten metal surface to initiate the wraparound of the molten metal on the reverse surface is 4 mm at the flow velocity of 0.2 m/sec. or 1.5 mm at the flow velocity of 0.5 m/sec.

The flow velocity of the molten metal surface is preferably in a range of 0.2 m/sec. to 0.6 m/sec. especially 0.3 m/sec. to 0.5 m/sec.

When the flow velocity is too low, the wraparound of the molten metal on the reverse surface is found by slightly lowering the strip from the level of the molten metal. When the flow velocity is too high, a complicated apparatus for forming such high flow velocity is required and the energy used is too much.

The flow of the molten metal surface is resulted from a linear induction motor placed in the bath below the edge of the strip. The linear induction motor comprises a plurality of coils formed by winding copper tube on an iron core which are arranged with each predetermined gap to sequentially excite the coils so as to form a traveling field along the arranged coils. A current is induced in a conductive substrate by the magnetic field of the coils to form the magnetic field by the current when the conductive substrate is placed near the coils of the linear induction motor. The conductive substrate is moved along the travelling field by the functon of the internal magnetic field and the magnetic field of the coils.

In the embodiment of the present invention, a molten metal is the conductive substrate whereby the molten metal moves along the travelling field. The molten metal can be the various conventional molten metal such as one made of zinc as a main component and a small amount of aluminum or one made of lead as a main component.

Referring to the drawings, the embodiment of the present invention is illustrated.

Figure 2:
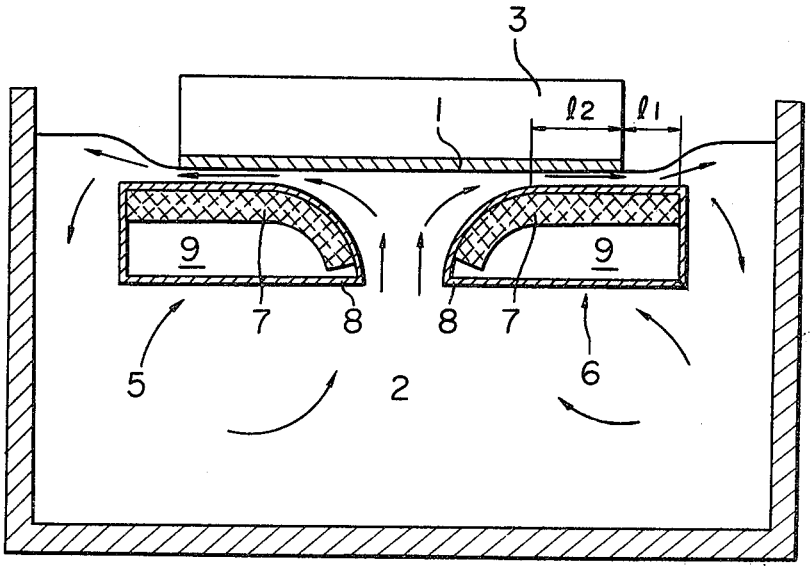
FIG. 2 is a sectional view taken along the line of A—A in FIG. 1.
Figure 3:
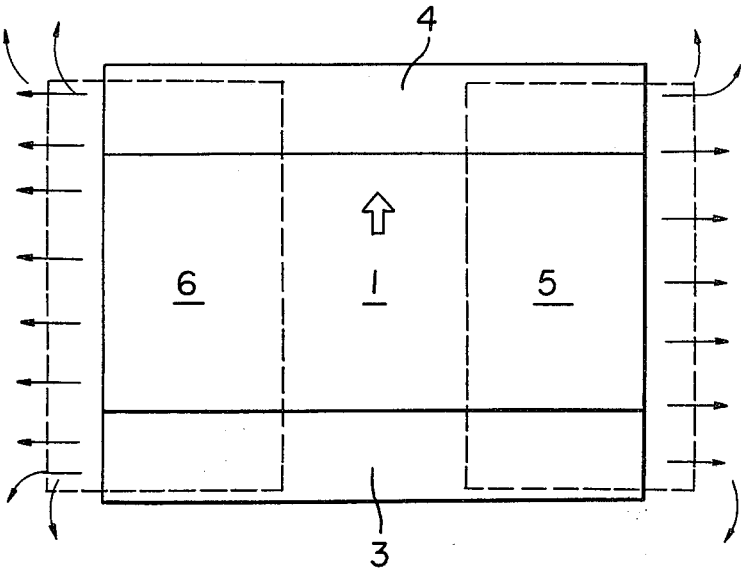
FIG. 3 is a plan view of FIG. 1.

FIG. 1 shows one embodiment of the apparatus used for the method of the present invention. FIG. 2 is a sectional view taken along the line A—A in FIG. 1. FIG. 3 is a plan view of FIG. 1.

In the apparatus shown in FIG. 1, a steel strip (1) which is heated in a reducible atmosphere to remove oxides on the surface, is continuously fed on the surface of the molten metal (2) which is kept in an non-oxidizable atmosphere with nitrogen gas or hydrogen gas to prevent the oxidization of the surface of the steel strip. A pair of rolls (3), (4) are placed on the molten metal surfaces so as to run the steel strip while contacting the one side surface of the steel strip with the molten metal surface. The one surface (lower surface) of the steel strip is coated with the molten metal between the rolls and is departed from the molten metal surface.

The linear induction motors (5), (6) are placed in the molten metal bath below the edges of the steel strip. The molten metal is flowed to the perpendicular direction to the running direction of the steel strip at the edges of the steel strip. Such flow of the molten metal surface can be formed even though a length of the linear induction motor is slightly shorter than the space between the rolls (3), (4) in the running direction of the steel strip. However, the flow velocity of the molten metal surface is lower at the part for initiating the contact or the part for departing the strip, whereby there is a possibility to cause the wraparound of the molten metal on the reverse surface. It is preferable to have a length of the linear induction motor the same as the space between the rolls (3), (4) or longer so as to maintain a desired flow velocity of the molten metal surface at the part for initiating the contact or at the part for departing the steel strip.

It is preferable to accelerate the flow of the molten metal surface below the edges by placing the linear induction motor from the inside to the outside of the edges in the transversal direction of the steel strip as shown in FIG. 2. The linear induction motor is preferably placed at a distance of 3 to 40 mm below the molten metal surface.

When it is too deep, the magnetic field on the molten metal surface is weak, resulting in a low flow velocity. When it is too shallow, the flow velocity of the molten metal surface is decreased by the friction of the linear induction motor and the steel strip.

The linear induction motor comprises stator (7) formed by winding coils on the iron core; a casing (8) for protecting the stator (7) and a gas cooling part (9) and the stator is placed by extending from the inside to the outside of the edges as shown in FIG. 2.

The molten metal surface contacting with both edges of the steel strip is flowed to the arrow direction departing from the steel strip and to reach the walls of the bath and the molten metal is downwardly flowed and then is upwardly flowed from the central part of the steel strip so as to recycle in the bath.

When the steel strip is brought into contact with the molten metal surface, the lower parts of the rolls (3), (4) are placed slightly lower than the level of the molten metal surface so as to run the steel strip below the level of the molten metal surface around the strip whereby no non-coated part is formed on the metal coated surface and no wraparound of the molten metal is found even though certain vibration is given by vibrations of the steel strip running at high velocity. The high speed metal coating is attained.

FIG. 3 is a plan view of FIG. 1. The flow directions in the plan of the molten metal surface are shown by the arrow lines. The steel strip (1) is coated by contacting with the molten metal surface between the rolls (3), (4). The molten metal surface contacting with the ends of the steel strip is flowed to the perpendicular direction departing from the steel strip.

Figure 4:
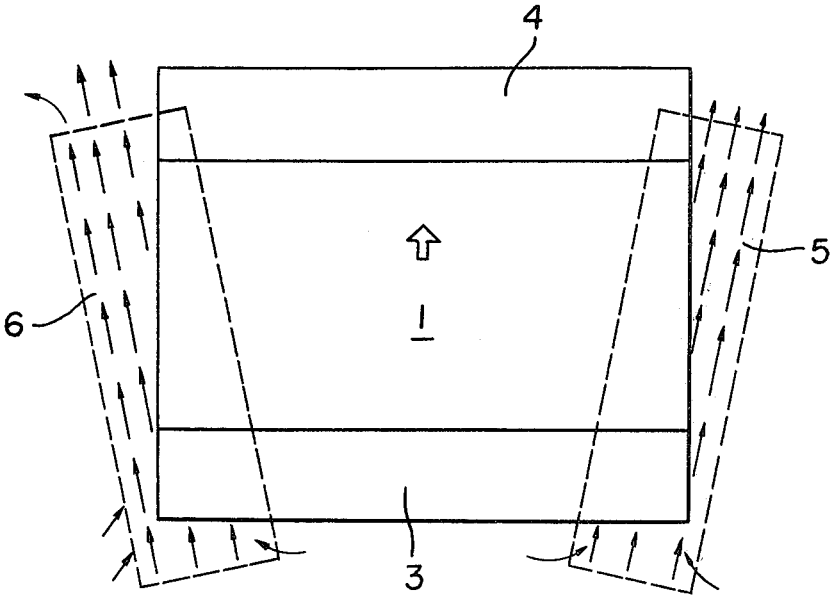
FIG. 4 is a plan view of another embodiment of the present invention.

FIG. 4 shows the other embodiment of the present invention. The linear induction motors (5), (6) for forming travelling fields in the longitudinal direction are placed to the slant direction to the running direction of the steel strip. The molten metal surface at the parts contacting with the edges of the steel strip is flowed to the slant direction departing from the steel strip as shown by the arrow lines by the linear induction motor.

When the steel strip is run below the level of the molten metal surface around the strip by rolls (3), (4), only one side surface of the steel strip is coated with the molten metal without any wraparound on the reverse surface.

Figure 5:
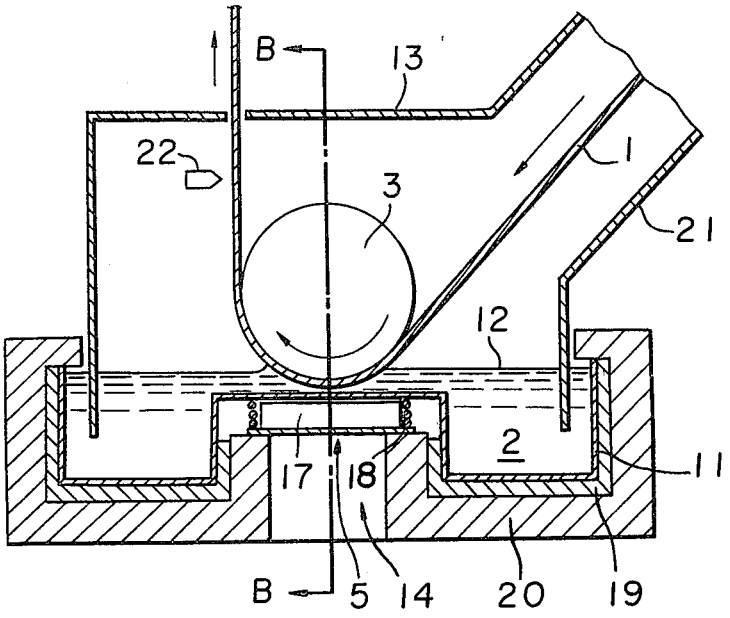
FIG. 5 is a sectional view of the other embodiment of the present invention.
Figure 6:
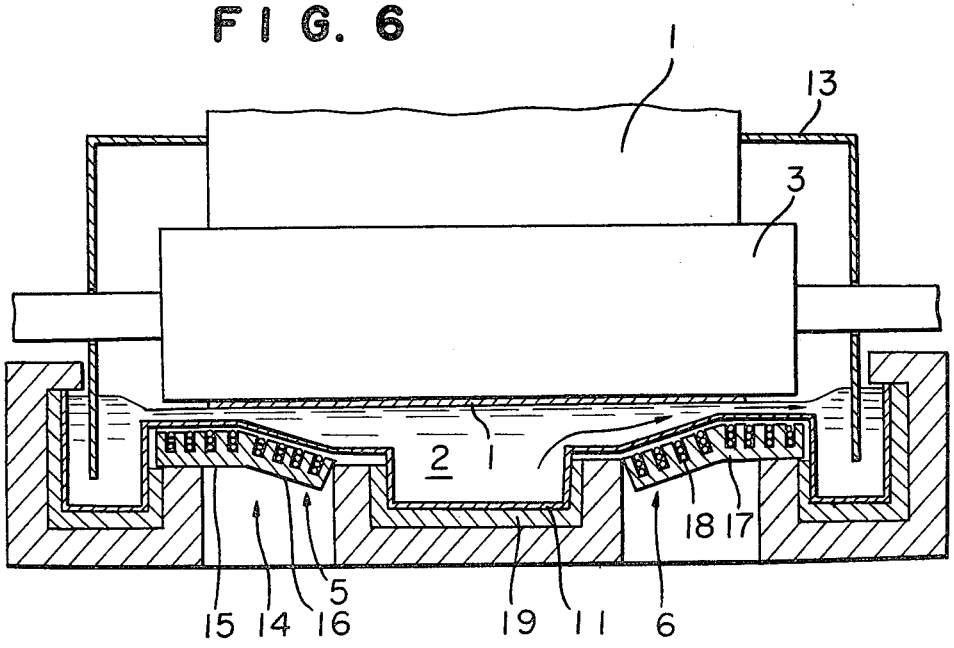
FIG. 6 is a sectional view taken along the line of B—B in FIG. 5.

FIGS. 5 and 6 show the other embodiments of the apparatuses used for the method of the present invention.

A seal case (13) for maintaining the non-oxidizable atmosphere on the bath surface (12) is formed above the bath vessel (11) containing the molten metal (2). The deflection roll (3) is placed above the molten metal surface to continuously contact the one side surface of the steel strip with the molten metal surface in the seal case. The deflection roll (3) is preferably placed in a range from 2 mm above the molten metal surface to 40 mm below the molten metal surface, especially in a range of 0 to 20 mm below the molten metal surface. When the position of the roll to the molten metal surface is too high, a non-coated part is formed on the lower surface of the steel strip. When the position of the roll to the molten metal surface is too low, a wraparound of the molten metal on the reverse surface is given by lowering the edge of the steel strip because of the strain etc.

In the bath vessel (11), the parts below the edges of the steel strip at the roll (3), are shallow and the shallow part (14) is upwardly opened and the linear induction motors (5), (6) are placed at the opening part. The linear induction motor comprises a horizontal part (15) and a slant part (16) which is downwardly slant to the center of the steel strip. The slant part is formed inside of the steel strip and the horizontal part is formed outside of the steel strip.

The horizontal part and the slant part respectively comprise the iron core (17) having a plurality of slots with each predetermined gap in parallel to the running direction of the steel strip and copper tube coils (18) placed in the slots for inducing the magnetic field by the combination of the iron cores and the coils. The tubes are connected to a water pump (not shown) placed outside of the induction motor to pass water into the tube for preventing the heating of the tubes and the iron cores by the molten metal bath. The copper tube coils are electrically connected to the power source so as to excite sequentially the arranged coils. Th magnetic field formed by the excited coil is increased by the iron cores to induce high current in the bath. The molten metal is flowed by the magnetic field caused by the induced current and the magnetic field caused by the coils.

The horizontal parts of the induction motor accelerate the flow of the molten metal surface at the edges of the steel strip and the roll. The slant parts feed the molten metal to the horizontal parts so as to assist the acceleration of the flow of the molten metal surface at the horizontal parts. The horizontal part of the linear induction motor is placed from the inside of the edge of the steel strip to the outside of the edge of the roll. The position of the joint of the horizontal part and the slant part is preferably in a range of 100 mm to 300 mm inside from the edge of the steel strip.

When the position of the joint is near the edge of the steel stip, the flow velocity of the bath surface at the edge of the strip is not enough to result in a wraparound of the molten metal in the condition that the edges of the steel strip is below the level of the molten metal surface. When the position of the joint is far departed from the edge of the steel strip, the horizontal part is too large and the cost is high. The outer position of the horizontal part is preferably in a range of 50 to 300 mm outwardly from the edge of the roll. When it is near the edge of the roll, there is a possibility to adhere the molten metal on the surface of the roll. When it is far departed from the edge of the roll, the horizontal part is too large and the cost is high. The length of the slant part is preferably in a range of 200 to 500 mm and the slant angle is preferably in a range of 1 to 30 degrees from the horizontal direction. When the length of the slant part is too short, the flow velocity of the molten metal surface at the edges of the steel strip and the roll is not satisfactorily high to adhere the molten metal on the surface of the roll or to cause a wraparound of the molten metal on the reverse surface. When the length of the slant part is too long, the cost is high. When the slant angle is larger or smaller, the efficiency of electric energy converted into the flow of the molten metal surface is lower.

A heater (19) is placed along the inner walls of the bath vessel for maintaining a desired temperature of the molten metal bath. A heat insulator (20) is placed on the outer surface of the heater (19). A snout (21) is to feed the strip into the apparatus and a wiping device (22) removes excess of the molten metal adhered on the surface of the steel strip. In the apparatus, the molten metal is flowed to the arrow direction from the central part of the bath vessel along the roll (5) outwardly by the linear induction motors (5), (6). The continuous steel strip (1) is continuously fed through the snout (21) at a rate of 50 to 150 m/min. to contact the lower surface with the surface of the flowing molten metal bath by the deflector roll (5). The steel strip coated with the molten metal is fed out of the apparatus after removing excess of the molten metal by the wiping device (22). In the apparatus, it is seldom to sink the strip into the molten metal by the vibration of the steel strip. Thus, the edge of the steel strip is sometimes lowered departing from the surface of the roll by strains of the steel strip. However, the wraparound of the molten metal is not found because of the flow of the molten metal surface. The molten metal is not adhered on the surface of the deflector roll outside of the edges of the strip because the molten metal surface at the parts is lower than the lower surface of the steel strip by the acceleration of the flow by the linear induction motor.

In accordance with the present invention, a wraparound of the molten metal on the reverse surface is not happened even though the steel strip is lowered below the level of the molten metal. Therefore, it is possible to coat the only one side surface at high speed for causing large vibrations. The linear induction motor is used for the flow of the molten metal surface and accordingly, the flow velocity of the molten metal surface is easily controlled by the power supplied to the induction motor. The current formed in the molten metal by the induction motor is consumed as an energy for flowing the molten metal and a heat energy. The heat energy is utilized for maintaining the temperature of the molten metal bath.

The present invention will be further illustrated by certain examples which are provided for purposes of illustration only and are not intended to be limiting the present invention.

EXAMPLE 1

A molten zinc alloy containing 0.2 wt.% of Al was maintained at 460° C. to prepare a molten metal bath. A linear induction motor was placed at the position of 20 mm below the molten metal surface and a power was supplied to the induction motor so as to flow the molten metal on the induction motor. A steel plate having a thickness of 0.8 mm was fed from the upper part of the flowing molten metal surface. The relation of the flow velocity of the molten metal surface to the distance h from the molten metal surface to the upper surface of the steel plate at the initiation of the wraparound of the molten zinc alloy from the edge of the steel plate on the reverse surface under flowing the molten metal surface to depart from the edge. The results are shown in Table 1.

TABLE 1

| $\mu$(m/sec.) | h (mm) |
|---|---|
| 0 | 4.0 |
| 0.1 | 5.0 |
| 0.2 | 16.0 |
| 0.3 | 18.0 |
| 0.4 | 18.3 |
| 0.5 | 18.5 |

The results show the fact that a wraparound of the molten metal is not happened even though the steel plate is run in deeper depth from the normal molten metal surface when the flow velocity of the molten metal surface is higher.

EXAMPLE 2

In the apparatus shown in FIGS. 1 and 2, a continuous steel strip was continuously fed to coat a molten metal on the one side surface of the steel strip. The molten metal bath was made of the same alloy as that of Example 1 and was maintained at the same temperature. The linear induction motor had a horizontal part having a length $l_1$ outwardly from the edge of the strip and a length $l_2$ inwardly from the edge of the strip and had a curved part downwardly inside of the horizontal part. The lengths are $l_1$ of 250 mm and $l_2$ of 150 mm. A deflector roll was placed to have a gap of 7 mm between the lower surface of the deflector roll and the upper surface of the linear induction motor. When the molten metal was charged into a bath vessel to reach the molten metal surface to the horizontal part of the induction motor, the induction motor was driven to flow the molten metal. The molten metal was further charged to reach a level of the molten metal surface at 20 mm above the horizontal part of the induction motor. The steel strip was run to the arrow direction at a rate of 0.7 m/sec. under continuously contacting the lower surface with the molten metal. The molten metal avove the horizontal part of the linear induction motor was flowed at a flow velocity of 0.4 m/sec. to the arrow direction i.e. outwardly from the edges of the steel strip. The power W was supplied. Sometimes, the edge of the steel strip was lowered between the deflector rolls (5), (6) for 16 mm below the normal molten metal surface. However, a wraparound of the molten metal on the reverse surface from the edge of the steel strip was not found.

EXAMPLE 3

In the apparatus of FIGS. 5 and 6, a one side surface of a continuous steel strip having a thickness of 0.8 mm and a width of 1.2 m was coated with a molten metal. A deflector roll having a length of 1800 mm was placed (the lower surface) at the position of 7 mm above a horizontal part of a linear induction motor, which was extended outwardly for 400 mm from the edge of the strip (100 mm from the edge of the roll) and inwardly 200 mm from the edge of the strip. A slant part was formed inside of the horizontal part for a width of 400 mm at a slant angle of 5 degree.

In accordance with the method of Example 2, the molten zinc alloy was charged and the linear induction motor was driven and the molten zinc alloy was further charged to a depth of 20 mm of the molten metal above the horizontal part of the linear induction motor. The molten metal above the induction motor was flowed at a flow velocity of 0.35 m/sec. to the arrow direction under supplying a power of 700 W. The level of the molten metal at the edges of the roll was lowered for 6 mm not to contact the molten metal with the edge of the roll. The steel strip was run at a rate of 1.7 m/sec. Sometimes, the edge of the steel strip was lowered below the roll for 17 mm below the normal molten metal surface. However, a wraparound of the molten metal on the reverse surface from the steel strip was not found.

We claim:

1. A method for one side metallic coating of a continuous metal strip with metal from a metal bath having a normal surface comprising:

moving said metal strip in a running direction through a metallic coating contact area;

maintaining said metal strip, in said contact area, substantially linear in a direction transverse to said running direction; and utilizing linear induction motor means in said bath to move the molten metal adjacent said normal surface in a second direction at least adjacent the transverse edges of said metal strip, said second direction having a component transverse to said running direction, and said second direction being entirely in the plane of said surface, whereby one entire surface of said metal strip is contacted with said molten metal.

2. A method according to claim 1 wherein said molten metal surface is flowed by said linear induction motor placed below said molten metal.

3. A method according to claim 1 wherein the flow velocity of said molten metal surface is in a range of 0.2 to 0.6 m/sec.

4. A method according to claim 3 wherein said molten metal surface is induced to flow by said linear induction motor means placed at a position of 3 to 40 mm below said molten metal surface.

5. A method according to claim 4 wherein said molten metal surface is induced to flow by said linear induction motor means placed at a position in a range of from 300 mm inwardly from a transverse edge of said metal strip to 400 mm outwardly from a transverse edge of said metal strip.

6. A method according to claim 1 wherein said molten metal is made of zinc as a main component.

7. An apparatus for one side metallic coating of a continuous metal strip, comprising:

a bath vessel for containing a molten metal bath having a normal surface;

means for moving said metal strip in a running direction through a metallic coating contact area, the surface of said metal strip in said contact area being held substantially linear in a direction transverse to said running direction; and linear induction motor means in said bath and adapted to move the molten metal adjacent said normal surface in a second direction at least adjacent the transverse edges of said metal strip, said second direction having a component transverse to said running direction, and said second direction being entirely in the plane of said surface, whereby one entire surface of said metal strip is contacted with said molten metal.

8. An apparatus according to claim 7 wherein said linear induction motor means includes a horizontal part which is in parallel to the plane of said normal molten metal surface and a connecting slanted part which is downwardly slanted adjacent the central part of said metal strip.

9. An apparatus according to claim 8 wherein said horizontal part of said linear induction motor is placed at a position in a range of from between 100 to 300 mm inwardly from a transverse edge of said metal strip to a range of from between 100 to 400 mm outwardly from an edge of said deflector roll.

10. An apparatus according to claim 7 wherein said roll is placed at a position in a range of from 2 mm above said normal molten metal surface to 40 mm below said normal molten metal surface.

11. The apparatus of claim 10 including:

means for maintaining said molten bath at a desired temperature;

a seal case over said bath for maintaining a non-oxidizable atmosphere over said bath surface; and at least one roll for deflecting said strip, moving in said running direction, into said contact area.

* * * * *